United States Patent [19]

Bennett, Jr. et al.

[11] 4,077,163

[45] Mar. 7, 1978

[54] PIVOT MECHANISM FOR GRINDING WHEEL INFEED

[75] Inventors: Robert Gordon Bennett, Jr., Seymour; Alfred Theodore Parrella, Newtown, both of Conn.

[73] Assignee: USM Corporation, Boston, Mass.

[21] Appl. No.: 709,334

[22] Filed: Jul. 28, 1976

[51] Int. Cl.[2] ..... B24B 49/00

[52] U.S. Cl. ..... 51/165.77; 51/33 W; 51/49

[58] Field of Search ..... 51/165 R, 165.77, 165.8, 51/33 R, 33 W, 49

[56] References Cited

U.S. PATENT DOCUMENTS

| | | | |
|---|---|---|---|
| 2,003,883 | 6/1935 | Grundstein | 51/49 UX |
| 3,374,585 | 3/1968 | Klein | 51/165.77 |
| 3,456,394 | 7/1969 | Welsh | 51/165.77 |

FOREIGN PATENT DOCUMENTS

| | | | |
|---|---|---|---|
| 229,173 | 1/1963 | Austria | 51/33 R |
| 228,862 | 11/1910 | Germany | 51/33 W |
| 941,175 | 11/1963 | United Kingdom | 51/33 W |

*Primary Examiner*—Harold D. Whitehead

*Attorney, Agent, or Firm*—Donald N. Halgren; Richard B. Megley; Vincent A. White

[57] ABSTRACT

The apparatus of this invention is for use in a grinding machine and consists of a mechanism constructed for rotatably mounting the wheelhead support structure of the grinding wheel for movement about an axis eccentric from the axis of the grinding wheel. A lever fixed to the wheelhead structure transmits motion from a lead screw to pivot the wheelhead about its axis, thereby moving the wheel in a manner to provide infeed for the grinding machine. The drive motor for the grinding wheel is separately mounted for coupled movement therewith.

1 Claim, 4 Drawing Figures

35
30
26
25
24
28
34
29
23
21
20
18
31
19
22
27
17
8
12

PIVOT MECHANISM FOR GRINDING WHEEL INFEED

BACKGROUND OF THE INVENTION

The grinding machine of the prior art basically consists of a headstock and a tailstock between which is mounted the workpiece for rotary motion. The workpiece typically is a steel roll used in the paper or steel industry which must be ground to a generally cylindrical shape within extremely precise tolerances. A grinding wheel is mounted for rotation on a subbase which can be moved towards and away from the roll. The subbase in turn is mounted for such sliding motion on a carriage which may be translated along the length of the workpiece. In order to provide a fine adjustment to the grinding wheel infeed, the wheel is mounted on a structure called the wheelhead. The wheelhead of the prior art comprises a large cast structure which is mounted to the subbase for pivotal motion transverse to the longitudinal axis of the roll. By pivoting the wheelhead about its axis which is offset from the grinding wheel axis, infeed movement of the grinding wheel may be obtained.

A majority of the equipment associated with the driving and control of the grinding wheel are mounted on the wheelhead thereby creating an element in the machine having a significantly large mass. Although the advantages of this type of infeed are significant, the structure is inherently dynamically soft. The predominant dynamic forces on the wheelhead act in a horizontal direction as a result of the forces acting between the grinding wheel and the roll. The most significant structure in opposition to these forces is the bearing surface at the pivot axis of the wheelhead. This fact coupled with the large mass of the wheelhead creates a serious problem in obtaining an accurate surface finish on the roll.

These same factors are true with respect to the static forces which will also cause problems in limiting accuracy, but to a lesser extent.

It is, therefore, the purpose of this invention to substantially reduce the mass of the wheelhead assembly while increasing the bearing surfaces which are responsive to the dynamic and static forces.

BRIEF SUMMARY OF THE INVENTION

The wheelhead of the subject invention is constructed in a substantially cylindrical configuration and is mounted on the grinding wheel subbase for rotary movement about its axis. The wheelhead is mounted within a large bearing to increase the available bearing surface. The grinding wheel axle is mounted for rotation within the wheelhead. The axis of rotation of the grinding wheel is located sightly offset from the axis of the wheelhead. A lever is fixed to the wheelhead, and extends radially outward therefrom where it is connected to a lead screw to cause controlled rotation of the wheelhead. As the wheelhead is rotated, the axis of the grinding wheel and therefore the grinding wheel moves towards or away from the workpiece, thereby providing a finely adjustable infeed for the grinding operation. Since the wheelhead is now substantially reduced in size, the drive motor for the grinding wheel is mounted on a separate support which is in turn mounted for movement on ways in the subbase. The rotary motion of the drive motor is transmitted to the grinding wheel spindle by means of belts and pulleys.

Since the motor support is now separate and relatively movable with respect to the wheelhead, it must be coupled to the wheelhead through a system of levers in order to maintain the distance between the centers of rotation of the drive pulleys constant.

DESCRIPTION OF THE DRAWING

The invention will be described in detail with reference to the appended drawing and in said drawing.

DETAILED DESCRIPTION OF THE INVENTION

The Preferred Embodiment

Figure 1:
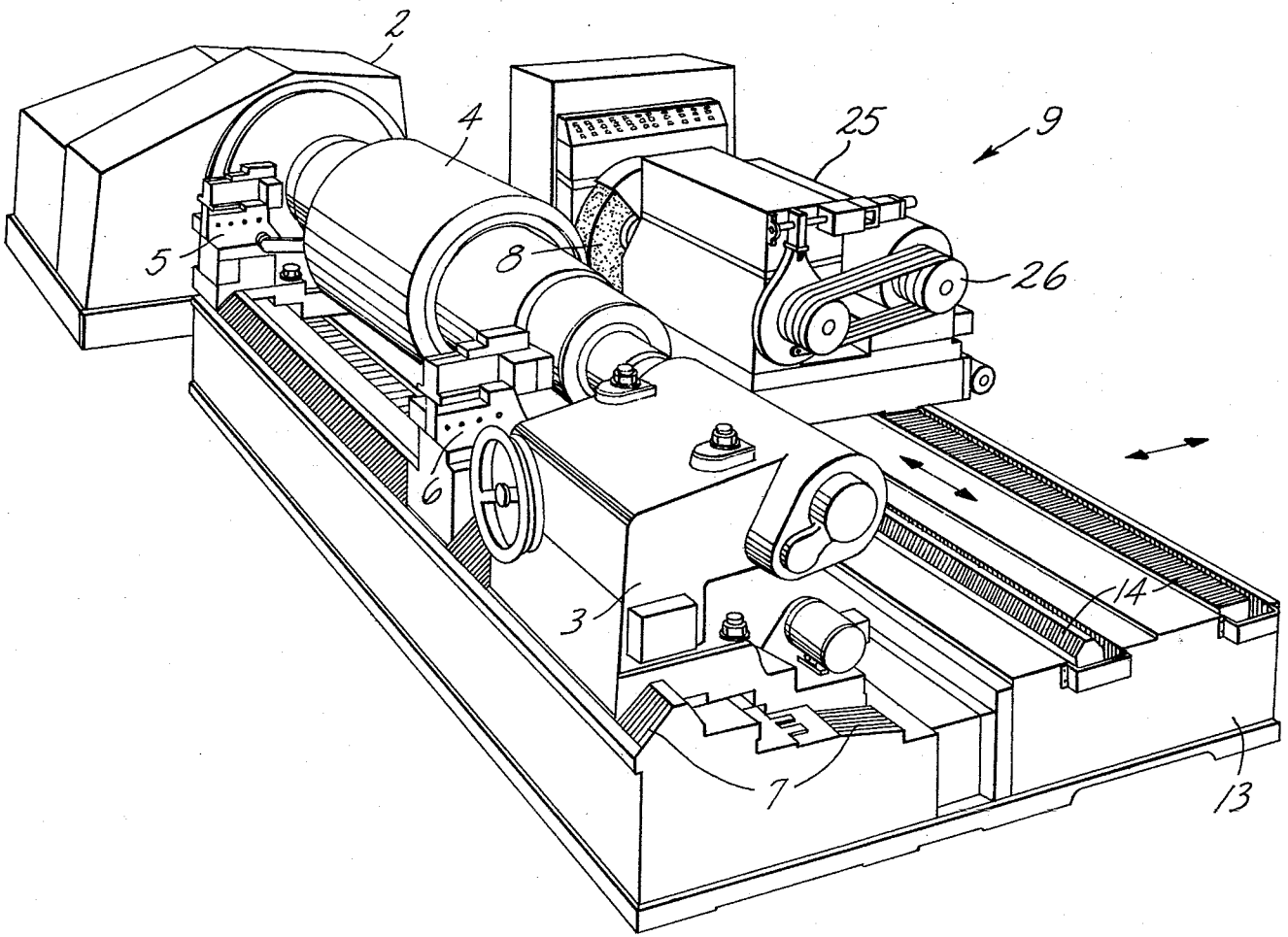
FIG. 1 is a perspective view of a roll grinding machine constructed in accordance with the principles of the present invention.

The roll grinder 1, to which the apparatus of this invention is adapted, is shown in FIG. 1. It basically consists of a headstock 2 and tailstock 3 between which a roll 4 is mounted for rotation during the grinding operation. The roll 4 is supported by neck rest and gib assemblies 5 and 6. Tailstock 3 is mounted on ways 7 for position adjustment to the length of the roll 4. The roll 4 is driven through operative engagement with headstock 2. The grinding tool comprises an abrasive wheel 8 which is mounted on a wheelhead 9. The subbase 10 is secured to carriage 12 by means of ways (not shown) in order to allow sliding motion of the subbase 10 on carriage 12 in a direction transverse to the axis of roll 4. The carriage 12 is mounted on the machine base 13 on ways 14 to allow movement of the carriage 12 in a direction parallel to the axis of roll 4.

In operation the grinding wheel 8 is moved longitudinally on carriage 12 as the roll is rotated. The grinding wheel is adjusted to contact the roll by transverse infeed movement on the subbase 10.

Figure 2:
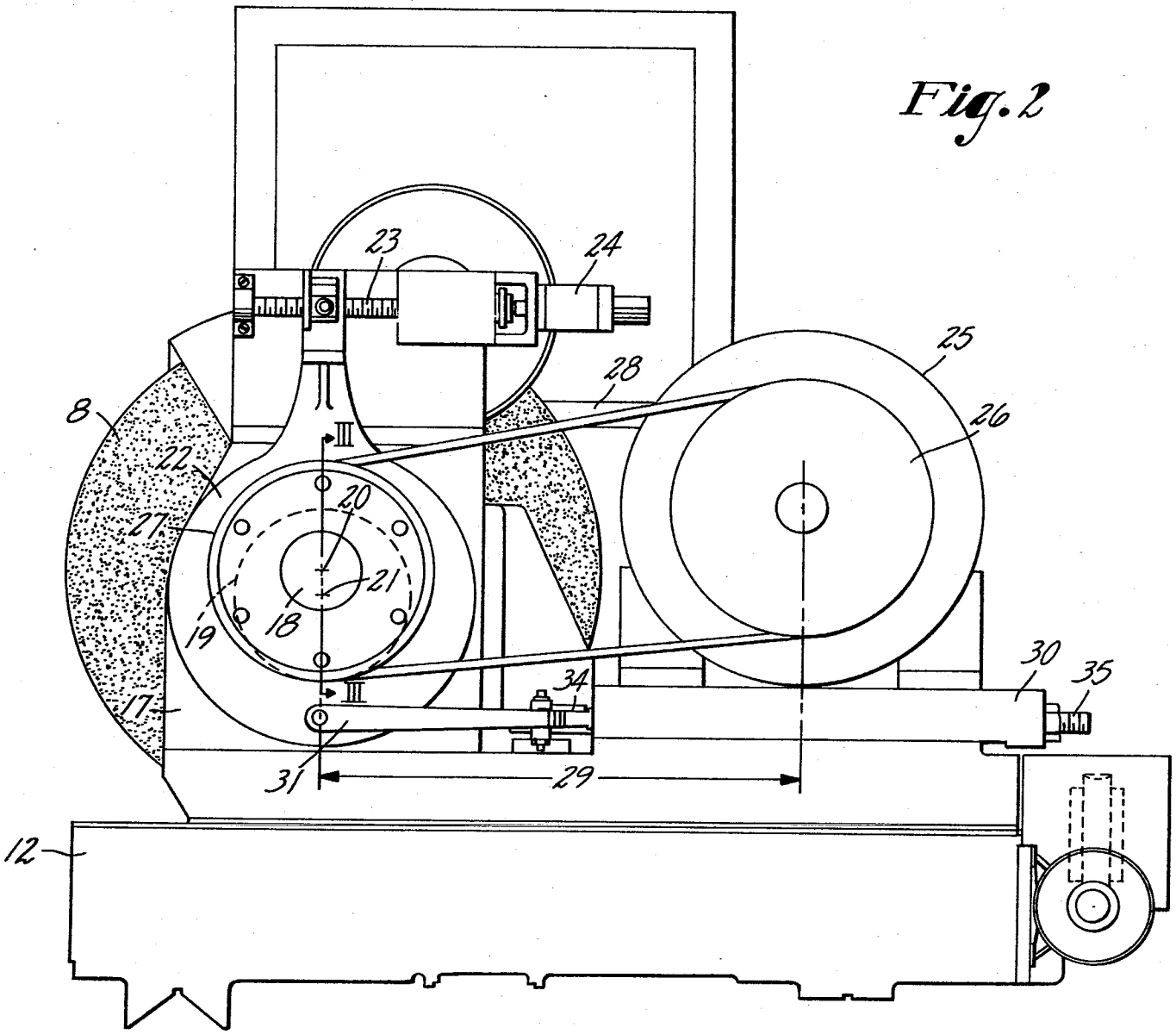
FIG. 2 is a side view of the abrasive wheel support structure and infeed mechanism of this invention.
Figure 3:
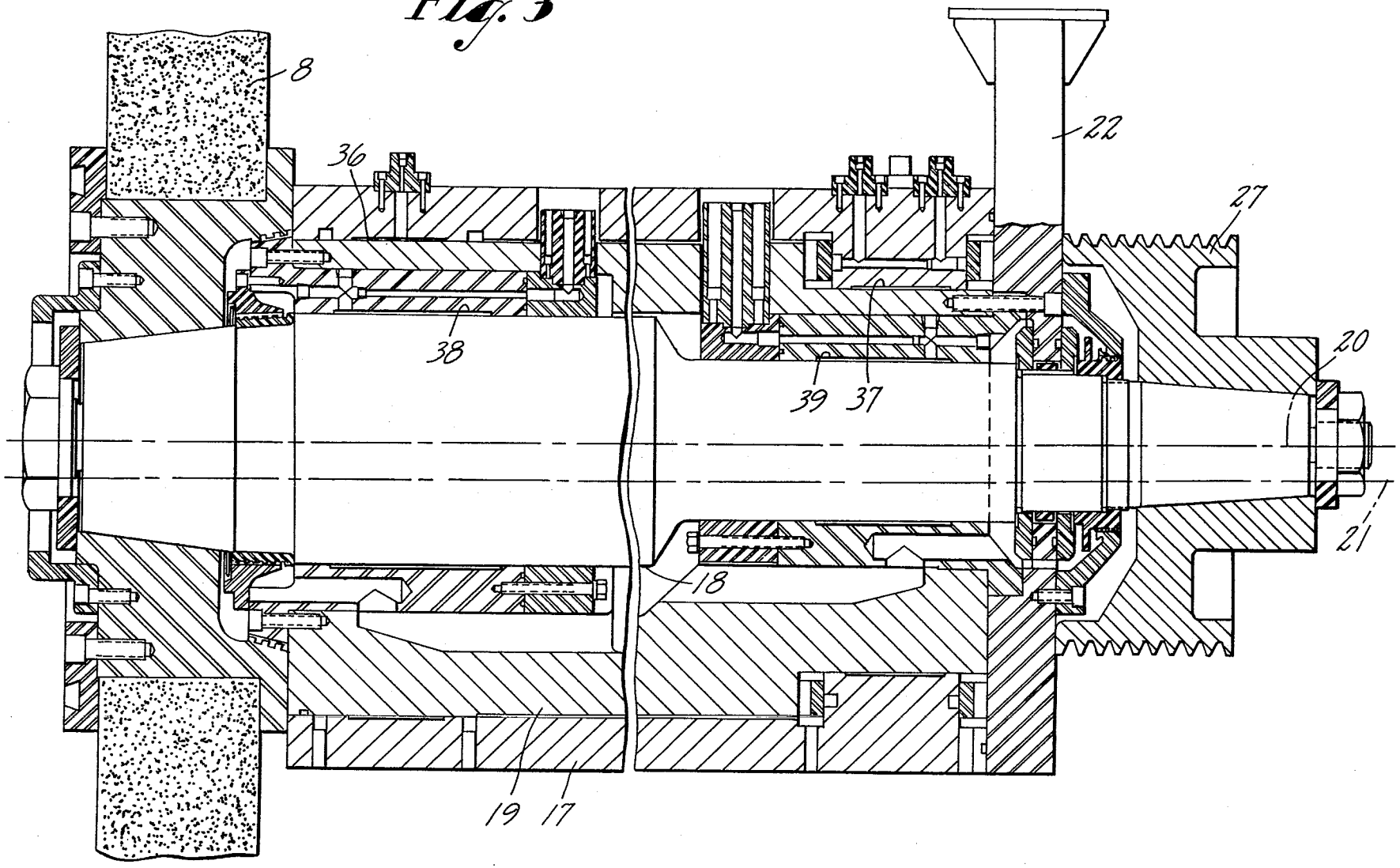
FIG. 3 is a cross sectional view of the wheelhead and spindle bearing support of this invention substantially through section lines 3—3; and, FIG. 4 is a top view of the abrasive wheel structure showing the drive motor coupling mchanism.

The infeed mechanism of this invention is best shown in FIGS. 2 and 3. It consists of a subbase 17 mounted on carriage 12 by means of ways which allow transverse sliding motion. This motion provides part of the infeed adjustment for the abrasive wheel 8 while the carriage 12 provides the longitudinal feed. Abrasive wheel 8 is mounted for rotation on spindle 18 which is in turn mounted in wheelhead 19 for rotation about axis 20. The wheelhead 19 is secured in subbase 17 for rotation about axis 21. Wheelhead 19 is operatively connected through lever 22 to lead screw 23. By driving lead screw 23 with motor 24, controlled rotation of wheelhead 19 about axis 21 is accomplished. This rotation will cause the axis 20 of spindle 18 to translate through an arc in a direction towards or away from a workpiece, such as roll 4 shown in FIG. 1. It is observed that this movement will directly result in infeed positioning of the abrasive wheel 8.

Figure 4:
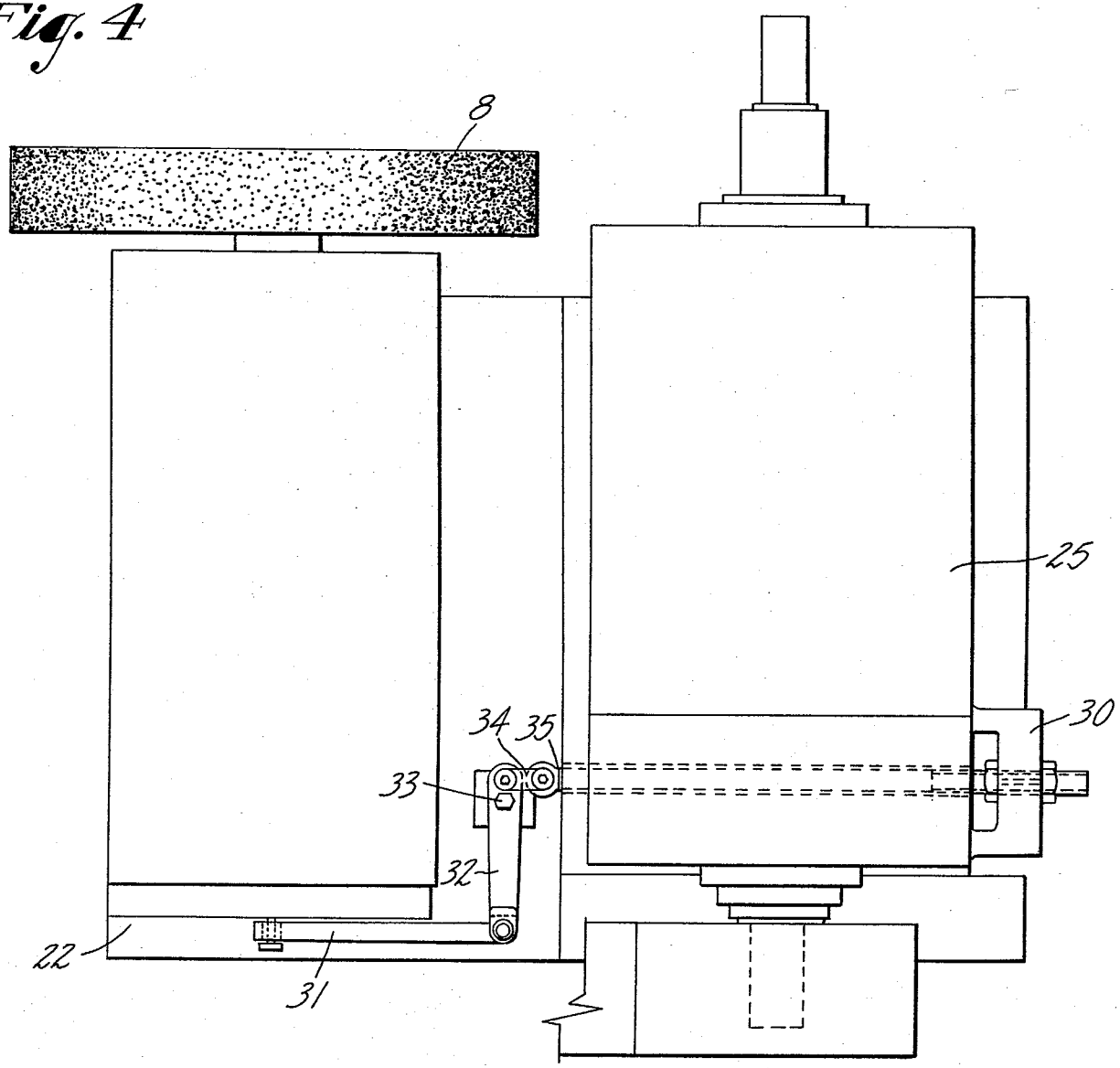

The spindle 18 is driven by motor 25 through drive pulleys 26 and 27 which are connected by belts 28. Since the distance 29 between the centers of rotation of pulleys 26 and 27 must be maintained constant in order for the drive system to operate, the motor 25 must be movable relative to subbase 17. To accomplish this motor 25 is mounted on a separate base 30 which in turn is mounted on ways in subbase 17 for sliding motion parallel to the direction of infeed. By coupling motor base 30 to the wheelhead 19 the distance 29 can be fixed. A link 31 is, therefore, connected to lever 22 at a distance below the wheelhead axis 21. As shown in FIG. 4, link 31 is pivotally connected to link 32 and link 32 is rotatably fixed to pivot 33. Link 32 is connected to motor base 30 at a point beyond pivot 33. This connection is accomplished by means of an additional link 34 through tie rod 35. The pivot motion of lever 22 is therefore transmitted through linkage assembly 31 through 34 to motor base 30 and is calculated to maintain distance 29 at a fixed value.

The supporting structure of wheelhead 19 and spindle 18 are best shown in FIG. 3. The wheelhead 19 is supported by two hydraulic bearing assemblies 36 and 37 which provide an axis of rotation 21 for the wheelhead 19. Spindle 18 is mounted within wheelhead 19 by a pair of hydrostatic bearing assemblies 38 and 39 which provide an axis of rotation 20 for the spindle 18.

Actuation of the infeed mechanism is initiated by energizing motor 24 which, through lead screw 23 and lever 22, will cause rotation of the wheelhead 19 about its axis 21. The motion will cause spindle 18 to pivot about axis 21, thereby moving abrasive wheel 8 towards or away from the roll 4. Since this motion is accomplished while the abrasive wheel 8 is being driven by motor 25 through belt and pulley system 26 through 28, the distance 29 must be maintained constant. This, as previously described, is done by coupling motor support 30 to spindle 18 by means of linkage assembly 31 through 34. The motor base 30 will therefore move an identical distance to the wheel 8.

In this manner the bearing surface supporting the wheelhead 19 is greatly increased while the mass of this structure is substantially reduced, thereby resulting in a significant increase in the dynamic strength of the grinding machine 1.

We claim:

1. A machine for grinding a workpiece with a rotatively powered abrasive wheel comprising, a wheel assembly mounted on a carriage for translation therewith along the length of the workpiece; means for providing infeed position adjustment between the abrasive wheel and its rotative empowerment including:

A. A sub base mounted on the carriage for movement towards and away from the workpiece having a support structure mounted thereon for sliding motion in a direction parallel to the infeed motion of the abrasive wheel;

B. a bearing assembly mounted on the sub base and constructed to receive a wheel support element for movement within said bearing and an electric motor fixed to the support structure to generate rotary motion;

C. a wheel support element mounted within the bearing for rotary motion about a fixed axis which is parallel to the axis of the workpiece, having a system of belts and pulleys operatively connecting the motor and a spindle of the abrasive wheel, to transmit rotary motion to the wheel;

D. said spindle constructed to permit rotary motion about a second axis parallel to the axis of the workpiece, said second axis being offset from said first a axis and means coupling the motor support structure to the wheel support element to cause equal movement of the motor support structure in response to infeed movement of the abrasive wheel to maintain the distance between the centers of rotation of the system of belts and pulleys constant; and E. spindle drive means mounted on the sub base for movement relative to the sub base in response to a rotation of the wheel support element; and said means coupling the motor support structure to the wheel support element to cause equal movement therebetween, said means comprising:

a first link pivotally connected to said spindle drive means;

a second link pivotally mounted on the carriage;

a third link pivotally connected to said slidable motor support structure, said first link being pivotally connected to said second link and said second link being pivotally connected to said third link, movement of said first link causing a corresponding opposite motion of said third link thereby keeping the distance between the centers of rotation of said pulleys constant.

* * * * *

UNITED STATES PATENT OFFICE

CERTIFICATE OF CORRECTION

Patent No. 4,077,163 Dated March 7, 1978

Inventor(s) Bennett, Jr. et al

It is certified that error appears in the above-identified patent and that said Letters Patent are hereby corrected as shown below:

Column 4, Claim 1, Sub-Head C, Line 2, delete " fixed " and insert - first -

Column 4, Claim 1, Sub-Head D, Line 3, delete " a "

Signed and Sealed this

*First* Day of *August 1978*

[SEAL]

*Attest:*

RUTH C. MASON
*Attesting Officer*

DONALD W. BANNER
*Commissioner of Patents and Trademarks*